US008245418B2

(12) United States Patent
Paintin et al.

(10) Patent No.: US 8,245,418 B2
(45) Date of Patent: Aug. 21, 2012

(54) FRONT-OPENING FOOTWEAR SYSTEMS

(76) Inventors: Janet A. Paintin, Littleton, CO (US); Scott R. Paintin, Littleton, CO (US)

( * ) Notice: Subject to any disclaimer, the term of this patent is extended or adjusted under 35 U.S.C. 154(b) by 1010 days.

(21) Appl. No.: 12/074,040

(22) Filed: Mar. 1, 2008

(65) Prior Publication Data

US 2009/0217552 A1 Sep. 3, 2009

(51) Int. Cl.
*A43C 11/00* (2006.01)
*A43B 11/00* (2006.01)

(52) U.S. Cl. ..... 36/50.1; 36/138; 36/54; 36/72 R

(58) Field of Classification Search ..... 36/50.1, 36/138, 54, 72 R, 50.5, 4
See application file for complete search history.

(56) References Cited

U.S. PATENT DOCUMENTS

| | | | | |
|---|---|---|---|---|
| 526,626 | A | 9/1894 | Kregel | |
| 917,602 | A | 4/1909 | Helflinger | |
| 1,081,678 | A | 12/1913 | Langerak | |
| 1,124,710 | A * | 1/1915 | Crowley | 36/7.3 |
| 1,216,579 | A | 2/1917 | Lemieux | |
| 1,465,343 | A * | 8/1923 | Case | 36/51 |
| 1,945,420 | A * | 1/1934 | Charles | 36/72 B |
| 2,082,537 | A * | 6/1937 | Butler | 36/129 |
| 2,252,315 | A | 8/1941 | Doree | |
| 2,450,250 | A | 9/1948 | Napton | |
| 2,452,502 | A | 10/1948 | Tarbox | |
| 2,452,649 | A | 11/1948 | Graves | |
| 2,619,744 | A | 12/1952 | Mattes | |
| 2,734,284 | A | 2/1956 | Seurbom | |
| 2,815,588 | A | 12/1957 | Ruane | |
| 3,146,535 | A | 9/1964 | Owings | |
| 3,192,651 | A | 7/1965 | Smith | |
| 3,389,481 | A | 6/1968 | England | |
| 3,783,534 | A * | 1/1974 | Phillips et al. | 36/72 R |
| 3,997,985 | A | 12/1976 | Shiina | |
| 4,095,356 | A | 6/1978 | Robran et al. | |
| 4,120,103 | A | 10/1978 | Colby | |
| 4,136,468 | A | 1/1979 | Munschy | |
| 4,178,703 | A | 12/1979 | Pols | |
| 4,178,925 | A | 12/1979 | Hirt | |
| 4,281,466 | A | 8/1981 | Malone | |
| 4,376,344 | A | 3/1983 | Kimsey | |
| 4,377,913 | A * | 3/1983 | Stone | 36/99 |
| 4,559,722 | A | 12/1985 | Norton | |
| 4,745,693 | A | 5/1988 | Brown | |
| 4,783,909 | A | 11/1988 | Van Doren et al. | |
| 4,982,515 | A | 1/1991 | Sartor | |
| 5,127,170 | A | 7/1992 | Messina | |
| 5,184,410 | A | 2/1993 | Hamilton | |
| 5,282,327 | A | 2/1994 | Ogle | |
| 5,481,814 | A | 1/1996 | Spencer | |

(Continued)

OTHER PUBLICATIONS

AbleData, Pullman International Comfort Shoes, WaybackMachine archived page from abledata.com, Aug. 31, 2005, 2 pages, Published by AbleData, Silver Spring, MD.

(Continued)

*Primary Examiner* — Ted Kavanaugh

(57) ABSTRACT

The present invention relates to articles with cavities capable of receiving objects as a result of extending an opening into a cavity capable of receiving the objects. For example, the opening in an article of footwear can be extended into the toe box to allow for the easier insertion and removal of a foot. The present invention also relates to systems that permit the article to be secured to the object after it has been inserted.

18 Claims, 14 Drawing Sheets

U.S. PATENT DOCUMENTS

| | | | | |
|---|---|---|---|---|
| 5,551,172 | A | 9/1996 | Yu | |
| 5,600,901 | A | 2/1997 | Leonor | |
| 5,787,608 | A | 8/1998 | Greenawalt | |
| 5,901,394 | A | 5/1999 | Greenawalt | |
| 5,983,528 | A | 11/1999 | Hartung | |
| 6,971,192 | B2 * | 12/2005 | Shepherd | 36/54 |
| 7,650,705 | B2 * | 1/2010 | Donnadieu et al. | 36/50.5 |
| 2005/0178026 | A1 * | 8/2005 | Friton | 36/50.1 |
| 2005/0193596 | A1 * | 9/2005 | Culton et al. | 36/135 |

OTHER PUBLICATIONS

Select pages from Hatchbacks(R) Footwear website (www.hatchbacksfootwear.com)—5 pages included (Jun. 1, 2008).

Select pages from thewideshoes.com website (www.thewideshoes.com) describing the Answer2(TM) shoe—3 pages included (Jun. 1, 2008).

Select pages from the KeepingPace website (www.keepingpace.com)—3 pages included (Jun. 1, 2008).

* cited by examiner

FRONT-OPENING FOOTWEAR SYSTEMS

FIELD OF THE INVENTION

Aspects of embodiments generally relate to articles containing a cavity capable of receiving an object. Embodiments also relate to systems for opening and closing an object with a cavity so that an object can more easily be inserted or removed. One embodiment includes an article of footwear that more easily accommodates the insertion and removal of a foot, with or without an orthotic brace or orthotic insert, into the article of footwear by more fully opening than conventional footwear.

BACKGROUND

Some conventional footwear consists of a sole, which is attached, or coupled, to an upper with an opening in it to accommodate the insertion of a foot into, or removal of a foot from, the upper of the conventional footwear. In some cases, this opening may be the only means for a wearer to get an article of footwear over a foot, which can require the wearer to slide the entire front of the shoe over a foot. An example of such an article of footwear is a loafer.

In other cases, the opening in conventional footwear can be accompanied by a tongue that permits the footwear opening to be expanded to some degree by the wearer prior to inserting a foot into the footwear. Expansion of the footwear opening, however, is limited by the fact that the tongue meets up with, but does not extend into, the toe box formed by a cavity at the footwear front ("conventional toe box") into which the wearer's toes and forefoot are inserted when footwear is placed over the foot. Footwear containing a conventional toe box through which the tongue does not extend can be extremely difficult for many people to put on and remove. Even worse are conventional shoes that have no tongue and thus no ability to expand the footwear opening at all.

In contrast to conventional footwear, non-conventional footwear has often used alternative placement of the foot opening. For instance, some non-conventional footwear fully opens and closes by means of straps, flaps and tabs at the back. More particularly straps that wrap around the back of the foot that are secured by buckles, hinged flaps that fold up and down at the base of the heel, and sole tabs that are extended at the back to fold up and down around the heel.

Other non-conventional footwear has focused footwear that opens by sliding the rear portion of the footwear in relation to the front portion. This sliding is often accomplished by means of a guiding mechanism or mechanisms that allow the two portions of the footwear to telescopically connect with one another.

Still other non-conventional footwear has focused on footwear that opens at the middle by means of a hinge or hinges on the sole of the shoe. This is accomplished by either pivoting the shoe's heel open toward the inside of the shoe via a hinge located on the sole in front of the heel or by hinging the sole so that the rear portion of the shoe can drop in relation to the front of the shoe to create the foot opening. An example of such a shoe are Hatchbacks®, shoes that according Hatchbacks Footwear, Inc.'s website (www.hatchbacksfootwear.com) are patented hinged-sole shoes that open at the back to make it easy to fit a toddler with shoes. To accommodate ankle foot orthotics, the company employed this "Easy Fit" technology to develop its Elite shoe line, which is wider at the toe, has extra girth around the ankle, has a gently curved sole for a more natural walking gait, and uses lighter-weight synthetic materials.

Another shoe that is meant to accommodate ankle foot orthotics and knee ankle foot orthotics is the Answer2™ M shoe, which has a pre-molded long counter at the heel, an ultra-light EVA cushioned mid-sole, triple layer removable insoles and a wide, high, extra firm conventional toe box. Further information about Answer2™ shoes is available at the website http://www.thewideshoes.com/answer2-all-shoes.html.

Although various means for placing a foot into and removing a foot from footwear have been described above, each article of footwear contains a conventional toe box, which can be difficult, if not impossible for children, the elderly, and those with certain diseases or disabilities to put on and take off. This can be especially true when the wearer also has a orthotic brace, such as an ankle foot orthotic ("AFO"), dynamic ankle foot orthotic ("DAFO"), knee ankle foot orthotic ("KAFO") or supramalleolar orthotic ("SMAFO") (each an "orthotic brace"), or when the wearer uses an orthotic insert, or has a disease or disability impacting the muscles, joints, spinal cord or central nervous system. In the United States alone, it is estimated that between 5,000 and 10,000 babies are born each year with cerebral palsy, 1 out of every 1,000 people suffers from multiple sclerosis and 30,000 people are affected by the most prevalent form of muscular dystrophy. Many of those impacted by such diseases and disabilities need the support of an orthotic brace or orthotic insert (each an "orthotic"). Thus, an article of footwear that allows for the easier insertion or removal of a foot would be useful to a substantial segment of the population. Among other advantages, the present invention can overcome the limitations resulting from a toe box in both conventional and non-conventional footwear. In addition to those affected by disease or disability, dancers or certain athletes, such as those who run, ski, rock-climb, bike or participate in triathlons, may find beneficial an article of footwear or other foot-enclosing device that is easier to put on and remove. Such articles may also be appealing to members of the general population, including those who may have difficulty tying laces such as children or the elderly.

SUMMARY

Embodiments disclosed herein provide novel articles (by way of example, but not limitation, footwear) with a cavity (by way of example, but not limitation, a toe box enclosure (or "toe box")) that are capable of receiving at least a portion of an object by expanding an opening in an article into the cavity. A toe box may be defined by one or more of an upper member, a sole member, a flap, a hinge, and/or protective material, or any side, part or portion of the foregoing, or by all or a portion of any other component of an article of footwear. Embodiments may also include systems for expanding the opening in an article with a cavity and for securing the article to an object once the object has been inserted through the expanded opening.

Extending an opening into a cavity may occur in a wide variety of ways. For example, in embodiments involving footwear, the opening in the article of footwear may extend into the toe box along the top portion of the inside of the upper and around the top of the toe box to create a flap that opens to more easily accommodate the insertion or removal of a foot. The flap can then be secured by any appropriate securing mechanism(s) (by way of example, but not limitation, a hook and loop fastener such as a Velcro® fastener, with one side of the fastener being attached, or coupled to the inside of the flap and the other being attached, or coupled to the outside of the upper).

In other embodiments, the opening in an article of footwear may extend into the toe box through the center of the upper and along the top end of the toe box to create two flaps capable of opening to more easily accommodate the insertion or removal of a foot. These flaps can be secured by opposing pieces of a hook and loop fastener system, with one piece being on the outside of the first flap and the other being on the inside of the second flap.

In yet other embodiments, the opening in an article of footwear may extend from the top of the toe box through the center of the upper in an upward fashion to create two wing-like flaps that overlap to close over the foot. The first flap may have no attachment, while the second flap may have attached, or coupled to it a strap with a piece of hook and loop fastener secured on the inside. When the second flap is folded over the first flap, the piece of hook and loop fastener can be connected to the opposing piece of hook and loop fastener secured to the outside side of the upper opposite the second flap.

Other embodiments may employ a zipper or other securing mechanism to close a slit (which may be defined by the separation of two sides of the upper member) that can extend through the upper and into the toe box to create an extended opening to more easily accommodate the insertion or removal of a foot. A single slit may be centrally located at the top of the upper or multiple slits can be employed to create an even wider opening for the foot. Alternatively multiple zippers or other securing mechanisms may be used to close a plurality of slits that can extend through the upper member and into the toe box. Optionally, the footwear may have a loop attached, or coupled, to the top of the heel to permit the wearer to pull on the loop to cause flexible closure material located on either side of the top of the upper rear to expand, allowing the top of the heel to move outward so that a foot can be more easily inserted or removed.

In other embodiments, the top flap may extend into the toe box to allow for a foot to be more easily inserted into or removed from an article of footwear. When closed, the top flap can be secured to the upper by straps on either side of the top flap, each having opposing hook and loop pieces of material that can be stuck to one another after the straps have been inserted through buckles attached, or coupled, to both sides of the upper. A top flap may have two sides, a top end, and a lower end. Waterproof material or other protective material may be connected between the top rim of the front of the upper and the inside of the top flap and can be secured to the foot by a spring slide that causes a string or elastic band strung though hooks attached, or coupled, to the rim of the upper to collapse and close the waterproof material around the foot. Optionally, the footwear may have a loop attached, or coupled, to the top of the heel to permit the wearer to pull on the loop to cause flexible closure material located at the back of the upper rear to expand, allowing the top of the heel to move outward so that a foot can be more easily inserted or removed. Also optionally, the sides of the upper may be notched to accommodate a hinge, buckle, strap, rivet or snap on an orthotic brace such as an AFO.

Embodiments may contain one or more notches. A notch may be defined by a depression in the top rim of the upper member and may be any shape suitable for receiving any part of an orthotic, such as for example, a semi-circle, semi-oval, square, circle, triangle, rhombus, and/or parallelogram. A notch may be squared off or rounded where it meets with the top rim of the upper member. A notch may be open or may have flexible material attached, or coupled, to it. Flexible material attached, or coupled, to a notch may allow for easier insertion of a foot and/or orthotic, while providing greater stability than may be accomplished merely with an open notch. Flexible material may be rubber, elastic, nylon, Lycra®, neoprene, spandex, polyester, polypropylene, or other material capable of stretching, or any combination of the foregoing.

In yet other embodiments, openings into the base of the toe box may be located on either side of the upper so that the front of the upper is able separate from the sole. A waterproof material or other protective material may line the front of the upper and may be attached, or coupled, to the sole. Once a foot is inserted, the front of the upper can be secured to the sole by straps on either side of the upper, each having opposing pieces of hook and loop fastener material attached, being placed through a buckle attached, or coupled, to the sole. Optionally, the heel of the shoe also can be opened at a hinge located at the base of the heel and can be closed by straps extending from either side of the heel. The straps each may have attached, or coupled, one piece of hook and loop fastener material, with opposing pieces of hook and loop fastener material attached, or coupled, to the rear sides of the upper. The hinged heel also may have pieces of waterproof material attached, or coupled, from the base of the heel to the top of the heel.

In still other embodiments, the article of footwear can be a boot with a top flap that extends into the toe box. Connected to both the sides of the top flap and the top rim of the upper may be pieces of waterproof material. In one aspect of the embodiment, attached, or coupled, to the waterproof material on each side of the boot may be guiding loops through which string or an elastic band is extended through and connected to each side of the top flap. In another aspect, the guiding loops may be attached, or coupled, to the rim of the upper and vertically along the waterproof, with the string or elastic band connected to the top of the waterproof material. The string or elastic band can be cinched by a spring slide, causing the top flap and waterproof material to secure around a foot that has been inserted into the boot. In one aspect of the embodiment, once the top flap and waterproof material have gathered around a wearer's foot, the top flap can then further be secured by two straps, each having one piece of hook and loop fastener material attached, or coupled, to the inside, with the opposing pieces of hook and loop fastener material attached, or coupled, to the side of the upper. In another aspect, the top flap can be further secured by one or more securing flaps (by way of example, but not limitation, connected to each side of the top flap), with each securing flap having a piece of hook and loop fastener material attached, or coupled, to it that, when closed, will connect the opposing pieces of hook and loop fastener material attached, or coupled, to the top side of the upper near the rim.

BRIEF DESCRIPTION OF THE DRAWINGS

Further understanding of the objects, features and advantages of the present invention may be more fully understood by reference to the following detailed description and appended drawings in which.

In the Detailed Description that follows, as well as in the associated drawings, like reference numbers used throughout the description and the drawings refer to similar components.

DETAILED DESCRIPTION

Figure 1:
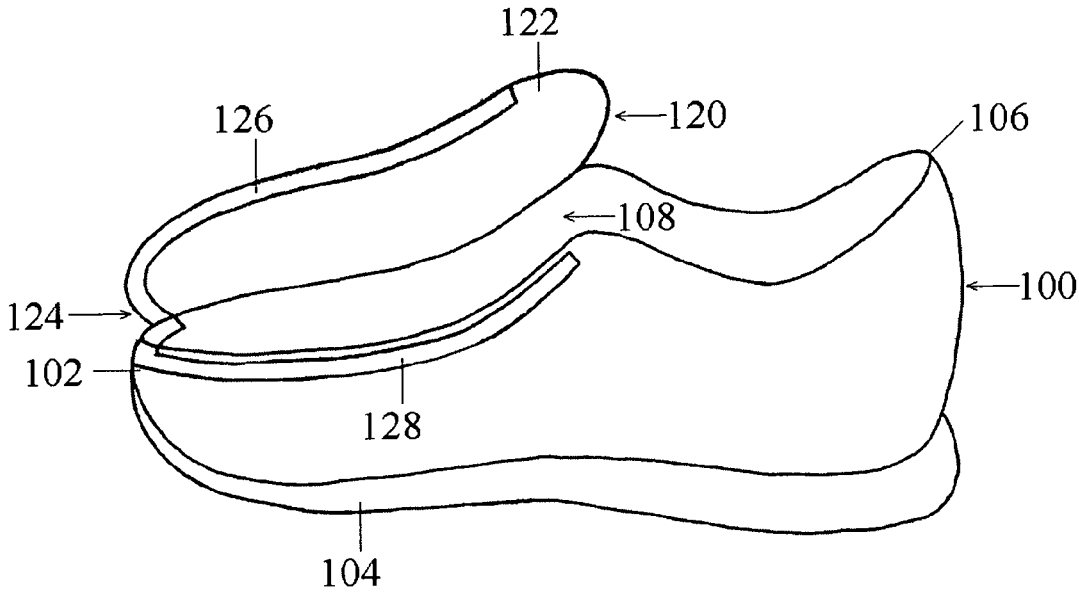
FIG. 1 illustrates an example of a shoe that has an opening that extends into the toe box along one side of the top rim of the front upper and continues around the toe box.

While various aspects of the invention have been summarized above, certain exemplary embodiments of the invention are described in further detail below. It should be noted, however, that the embodiments described are not intended to be, nor should they be interpreted to be, exhaustive or limiting descriptions of the invention. Instead, the embodiments described are examples provided for illustrative purposes only. While various embodiments are described, one skilled in the art should appreciate that various components and features described in one embodiment can be incorporated into other embodiments. Likewise, one skilled in the art should appreciate that certain components and features of the embodiments described can be omitted or substituted with components or features with similar functionality.

In general, aspects of the present invention relate to articles with cavities capable of receiving at least a portion of an object when an opening in the article is extended into the cavity. The present invention also generally includes systems for securing an article to an object once inserted through the extended opening. In certain exemplary embodiments, shoes and boots are shown with openings that extend into the toe box. While the drawings show shoes and boots, the present invention relates to any article with a cavity capable of receiving at least a portion of an object. Articles capable of receiving at least a portion of an object may include, for example, covers for tires, tents, sleeping bags, folding chairs, umbrellas, and sunglasses. In such a case, the object could be an inanimate object. Articles capable of receiving at least a portion of an object may also include, for example, footwear, ski and snowboard bindings, foot-enclosing devices such as snowboard bindings, bicycle pedal clips, and video game feet controls, hand-enclosing devices such as mittens and gloves, and hats. In such a case, the object could be a body part, such as a foot, hand or other appendage. For example, an article such as a mitten can have an opening that extends into the cavity beginning at the base of the mitten opposite the mitten's thumb and continuing along the outside of the mitten around the top and ending at the intersection of the main cavity capable of housing fingers and the thumb cavity. In this example, the opening could be extended to allow for easy insertion of a hand by means of a zipper and/or other securing mechanism and after a hand has been inserted secured around the inserted hand by closing the opening with the zipper and/or other securing mechanism.

Footwear may be any type of wearing apparel suitable for the feet and may include, for example, general athletic shoes; sport-specific shoes such as running shoes, basketball shoes, golf shoes, cleats, dance shoes (for example, jazz or hip-hop), ballet slippers, pointe shoes, rock climbing shoes, ice skates, roller skates, roller blades, ski boots and snowboarding boots; dress shoes; casual shoes; boots; sandals; clogs; mules; slippers and others.

A base of an article can be of any material suitable for attaching to an upper and can include a shoe, boot or slipper sole; rubber; plastic; acrylic; wood; metal; fiberglass; leather; vinyl or other man-made substance; elastic; nylon; Lycra®; neoprene; fleece; fur; fabric or other material, whether or not supportive of a foot or other object; a ski; a snowboard; or a bicycle pedal. In some embodiments, such as articles of footwear, an article base can be a sole member. A base or sole member may have one or more attached, coupled or integrated linking pieces capable of allowing the base or sole member to become detachably coupled to a locking mechanism. A linking piece may be any shape suitable for linking the base or sole member to another object. For example, a linking piece may be square, rectangular, triangular, semicircular, etc. The shape of a linking piece may follow the curvature of the base or sole member or may be squared off. A locking mechanism may be attached, or coupled, to or may be integrated into another object (such as a ski, snow board or pedal).

Likewise, an article top can be of any suitable material, which can include for example, leather, nylon, rubber, neoprene, Lycra®, plastic, acrylic, vinyl or other man-made substance, wood, metal, fiberglass, elastic, fleece, fur, fabric or other material. In some embodiments, such as articles of footwear, an article top can be an upper member ("upper" or "upper member"). An upper member can be a single unit or may be comprised of multiple pieces. For example, an upper member may have two sides (e.g., a right side and a left side) that may form the upper member. The two sides may serve to define one or more openings that extend into the upper member. For example, the front part of right side and the left side of the upper member may be capable of detachably coupling to each other so that when the two sides are decoupled, an opening extending into the toe box is formed. When coupled to one another by one or more securing mechanisms, the sides of the upper member are capable of securing around an inserted foot. Also by way of example, an upper member may have a front portion and a rear portion. The front portion may be capable of detachably coupling to the sole member. Alternatively, the top part of the front portion of the upper member may be capable of detachably coupling to the lower part of the front portion of the upper member, where such lower part is coupled to the sole member. An upper may also contain four portions—front-right, front-left, rear-right, and rear-left—or any other number of portions. Any one or more of the portions may have a top part and a lower part. An upper member may also have a back member that is separable from the other portions of the upper member and is capable of opening to permit a foot to more easily be inserted. When closed, a back member may be capable of at least partially cupping the heel of an inserted foot. After a foot has been inserted, the top rim of an upper member may be capable of closing around any point below, at, or above the ankle, calf or knee.

An upper member may have one or more notches, which may be defined by a depression(s) in the top rim of the upper member and may be any shape suitable for receiving any part of an orthotic. A notch may be open or may have flexible material attached, or coupled, to it.

An article top can be attached, or coupled, to an article base by any appropriate means, including without limitation, by stitching, sewing, tying, gluing, heating, chemically bonding, nailing, stapling, riveting or any combination of the foregoing. An article top and article base may also be a single integrated unit, for example, when made from the same mold.

In some embodiments a sole member, an upper member or both can be wider, can be deeper or can be both wider and deeper than conventional footwear.

Extending an opening into an article, such as an article of footwear, can include extending the opening into any portion of the article or all the way through the article. Extending an opening into an article may be accomplished by any means, including having the opening extend into, through, around and/or under any portion of the upper or the base. In some embodiments, extending an opening "into a toe box," "into the toe box," "into a cavity" or "into the cavity" can mean partially through, all the way through, around, under and/or over a toe box or cavity. Extending an opening into an article (including extending an opening into a toe box of an article of footwear) can also mean extending a plurality of openings into an article. An opening may be defined by any combination of sides, portions and/or parts of an upper member, a back member, a sole member and/or a top flap. An opening may be of any width. For example, an opening may be a slit defined by at least part of a first side and a second side of an upper member. Also, by way of example, an opening my be wider than a slit and formed by lifting of a top flap that is detachably coupled to at least one of a first side and a second side of an upper member. Many other widths and manners of creating an opening(s) are possible.

Examples of extending an opening into an article can include employing:

- one slit beginning at or near the top and front opening of the upper member and ending at or near the end of the toe box,
- two parallel, but not overlapping slits beginning near the top and front of the upper member and ending at or near the end of the toe box,
- two parallel, overlapping slits beginning near the top and front of the upper member and ending at or near the end of the toe box,
- two parallel slits, each beginning on opposite sides near the top and front of the upper member and ending on the same sides at or near the end of the toe box,
- two sets of parallel, overlapping slits, each beginning on opposite sides near the top and front of the upper member and ending on the same sides at or near the end of the toe box,
- two slits, each beginning at or near the top and front of the upper member, overlapping when closed in an "X" shape over the shoe tongue and ending on opposite sides at or near the end of the toe box,
- two slits, each beginning at or near the top and front of the upper member, overlapping when closed in a "V" shape and ending at or near the center of the end of the toe box, or
- a slit beginning at or near the top and front of the upper member, extending down one sided of the upper member, turning at or near the end of the toe box, and ending on the opposite side of the toe box to form an "L" or "J" shape flap In some embodiments, extending an opening into an article (for example, extending the opening of an upper into a toe box) is paired with opening the back of the article, for example a shoe back, by any suitable means (a "heel expanding system") to further ease inserting an object into and removing an object from an article. A heel expanding system can include loops, handles or other mechanisms for pulling the back of an article, flexible closure material (such as, for example, rubber, elastic, nylon, Lycra®, neoprene, spandex, polyester, polypropylene, or other material capable of stretching, or any combination of the foregoing or other material capable of stretching, or any combination of the foregoing) made a part of the back of the article or embedded in the article, a hinge or hinges at or near the back of the article, a hinged base or sole, a back telescopically connected to the front of the upper, or any combination of the foregoing. In some embodiments, by employing any of the means described above, a shoe or boot upper can have a heel portion (or "back member") capable of being moved outward to lengthen the foot opening.

Some embodiments include material that is capable of at least partially protecting an inserted object, such as a foot, from the elements ("protective material"). Such protective material may be waterproofing material, may be water resistant material or may have some other protective quality (by way of example, but not limitation, protection from heat, cold, snow, wind, etc.). Protective material may be at least partially gathered around an inserted foot by one or more securing mechanisms.

Once an object has been inserted into an article through an extended opening, the extended opening in the article can be closed by any means suitable for closing an opening in an article (a "securing mechanism"). For instance, a securing mechanism that can be used to close an article's opening can include, without limitation, string, lace, rope, elastic, rubber, neoprene, Lycra, a hook and loop fastener system such as Velcro, a zipper, spring slide, tongue, eyelet, guide, clasp, strap, snap, button, loop, hook, buckle, hinge, magnet or any combination of the foregoing, each individually or in multiple quantities. In addition, more than one securing mechanism may be employed, for example when use of a waterproof material or other protective material makes a second extended opening into an upper necessary or desirable a second securing mechanism may be useful. In some embodiments, multiple securing mechanisms can be utilized for multiple openings, such as employing a separate securing mechanism for each of an opening extended into a toe box, an opening extended by moving a heel outward, and/or an opening defined by waterproofing material or other protective material. In other embodiments, a securing mechanism can be used to secure more than one opening. For instance, a shoe string or elastic band can be run through hooks attached, or coupled, to both a top flap that extends into a toe box and a heel that extends outward so that both can be closed and secured to a foot by a single securing mechanism. Similarly, a single securing mechanism can be connected to both a top flap extending into a toe box and waterproofing or other protective material so that when the securing mechanism is closed, it secures the top flap and waterproofing or other protective material around an inserted foot.

Some embodiments may include one or more attached, or coupled, hinges. For instance, a hinge(s) may serve to couple other components of an article such as footwear. In an article of footwear, one side of a hinge may be connected to a back member, while the other side of the hinge may be connected to a sole member. Likewise, one side of a hinge may be attached, or coupled, to a top flap, while the other side of the hinge may be attached, or coupled, to a portion of the upper member. Similarly, one side of a hinge may be attached, or coupled, at or around the front of the toe box, while the other side of the hinge may be attached, or coupled, to a top flap. The hinge(s) may be attached, or coupled, to the inside or the outside of an upper member, a top flap, a toe box or a back member, or any combination of inside/outside attachment. For example, one side of the hinge(s) may be attached, or coupled, to the inside of the upper member, while the other side of the hinge(s) may be attached, or coupled, to the outside of a top flap. The hinge(s) may be single unit or the hinge(s)

may be comprised of two or more components. The hinge(s) may serve merely to connect various parts of the footwear or the hinge(s) may provide tension to assist in opening and/or closing various parts of the footwear (by way of example, but not limitation, top flap, securing flap, back member).

In some embodiments, a securing mechanism can be hidden from sight by decorative material. For example, after a securing mechanism such as a zipper comprised of teeth and a slide is closed, the teeth, the slide or the entire zipper may be hidden from sight by a decorative flap. A decorative flap can be made a part of or attached, or coupled, to an upper member, a base member or both. A decorative flap also may have the capability of detaching and reattaching to an upper member, a base member or both. For example, pieces of hook and loop fastener material can be used with a decorative flap to permit at least a portion of the decorative flap to detach and lift up when a zipper is pulled to close an opening in an article and to reattach over the teeth, the slide or the entire zipper. Alternatively, a securing mechanism can be hidden from sight or stored by means of a pouch attached, or coupled, to or made a part of an upper member, a base member or both. Decorative material may be of any substance and shape suitable for hiding a securing mechanism.

Moving to the drawings, FIG. 1 illustrates an example system 100 of an article of footwear 102 in which a sole member 104 is attached, or coupled, to an upper member 106 that contains an opening 108 for insertion of a foot. A top flap 122 coupled to one side of the front of the upper member 106 and detachably coupled to the other side of the front of the upper member 106 may be detached and opened to extend the opening 108 into the toe box of the footwear 102. When detached and opened, at least a portion of the top flap 122 can separate from the top of the upper member 106 along one side of the rim of the front of the upper member 106 and around the toe box. Once a foot has been inserted through the opening 108, the top flap 122 can be closed and secured to the upper member 106 by means of a closure system 120 employing a securing mechanism 124, in this embodiment opposing pieces of hook 126 and loop 128 fastener material. A closure system can employ any number of securing mechanisms. Although not shown, a hinge or hinges may be coupled to the top flap 122 and the upper member 106.

Figure 2:
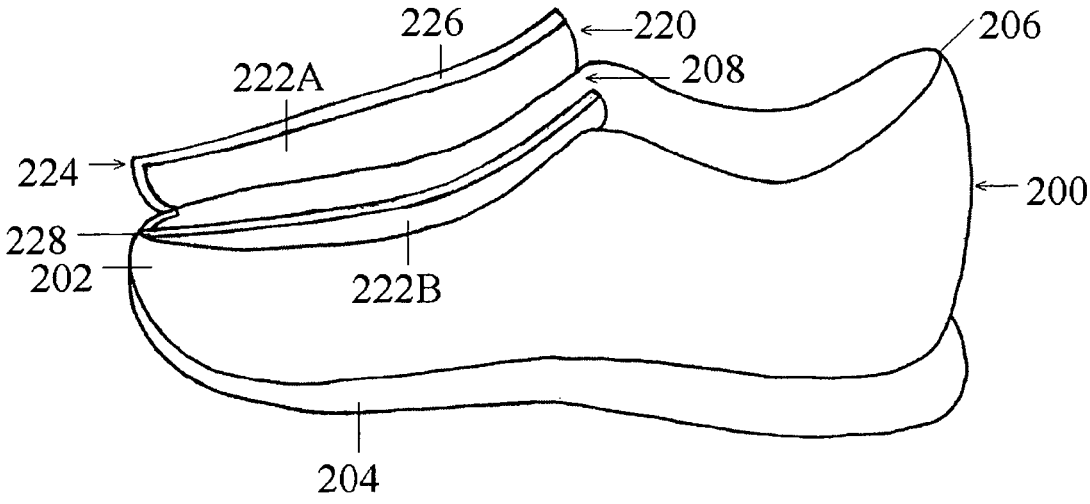
FIGS. 2 through 5 illustrate examples of a shoe that has an opening that extends into the toe box through a slit or slits at the top of the front of the upper.

FIG. 2 illustrates an example system 200 of an article of footwear 202 in which a sole member 204 is attached, or coupled, to an upper member 206 that contains an opening 208 for insertion of a foot. The opening 208 is capable of extending into a toe box by means of two top flaps 222A and 222B formed by separation of the top of the upper member 206 through the front. Once a foot has been inserted through the opening 208, the top flaps 222A and 222B can be closed and secured to each other by means of a closure system 220 employing a securing mechanism 224, in this case opposing pieces of hook 226 and loop 228 fastener material. Although not shown, a hinge or hinges may be coupled to one or both of the top flaps 222A and 222B and the upper member 206.

Figure 3:
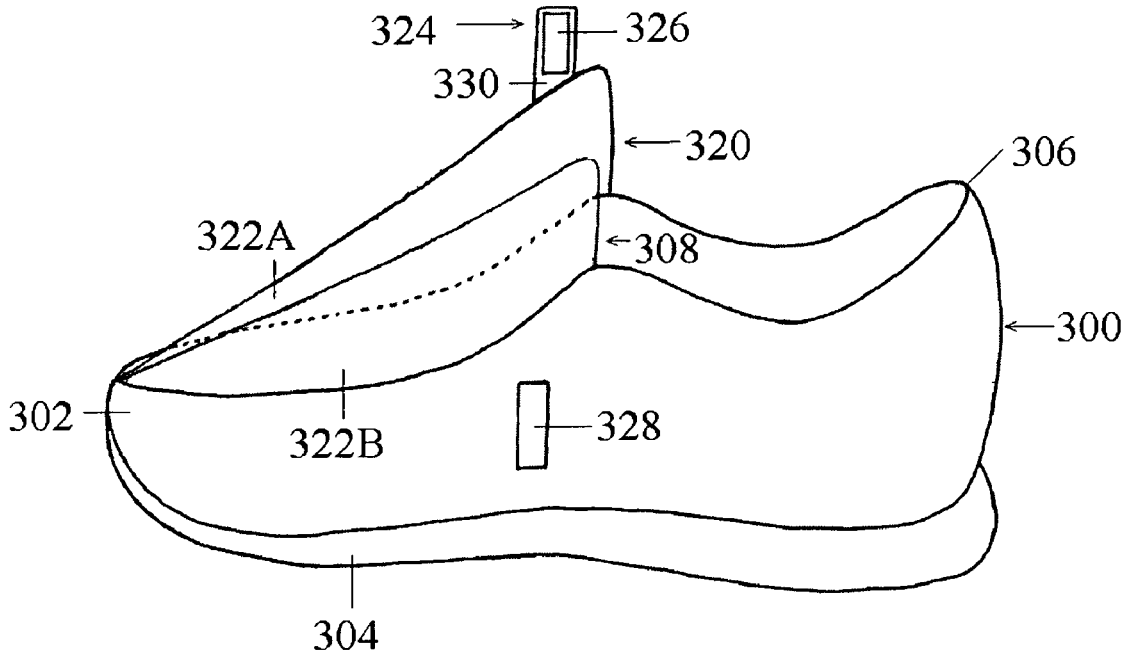

FIG. 3 illustrates an example system 300 of an article of footwear 302 in which a sole member 304 is attached, or coupled, to an upper member 306 that contains an opening 308 for insertion of a foot. The opening 308 extends into a toe box by means of two top flaps 322A and 322B, each with a wing-like shape, that start in the toe box and extend upward toward the opening 308. Once a foot has been inserted through the opening 308, the top flaps 322A and 322B are capable of being folded over each other so that the outer top flap 322B extends over the wearer's foot first and the inner top flap 322A, with a strap 330 attached, or coupled, to it, is configured to be folded over second. The wing-like flaps may be secured over the wearer's foot by means of a closure system 320 employing a securing mechanism 324, in this case opposing pieces of hook 326 and loop 328 fastener material, with one piece attached, or coupled, to the strap 330 and the other piece attached, or coupled, to the side of the upper member 306. Alternatively, the strap 330 could be attached, or coupled, to the outer top flap 322B so that the inner top flap 322A may be folded over a wearer's foot first and the outer top flap 322B may be folded over second, thereby allowing the opposing pieces of hook 326 and loop 328 fastener material to connect on the other side of the upper member 306. Although not shown, a hinge or hinges may be coupled to one or both of the top flaps 322A and 322B and the upper member 306.

Figure 4:
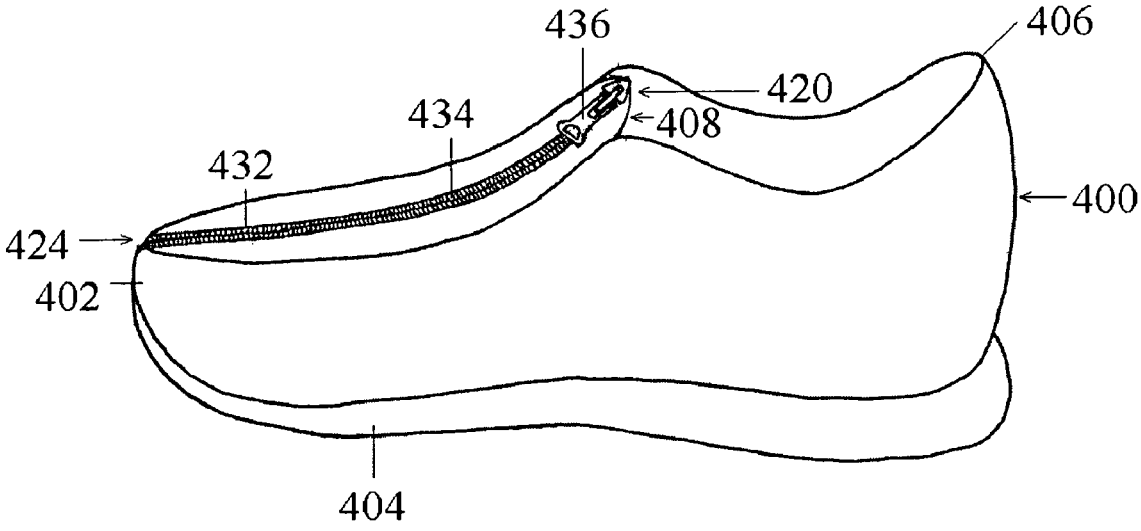

FIG. 4 illustrates an example system 400 of an article of footwear 402 in which a sole member 404 is attached, or coupled, to an upper member 406 that contains an opening 408 for insertion of a foot. The opening 408 extends into a toe box by means of a slit in the top of the upper member 406. In this embodiment, the slit is defined by two sides of the front of the upper member 406 that are detachably coupled to each other by means of a securing mechanism 424, in this case a zipper 432. Once a foot has been inserted through the extended opening 408, the footwear is capable of being secured to a wearer's foot by means of a of a closure system 420 employing a securing mechanism 424, in this case a zipper 432, with a slide 436 and teeth 434 connected to the upper member 406. Optionally and for added protection against the elements, a piece of protective material, which can be waterproof or water resistant (but does not necessarily have to be) can be attached, or coupled, to the inside of the upper member on either side of a zipper so that when the zipper is zipped, the material is capable of being situated under the zipper. Although not shown, the upper member 406 may include one or more notches defined by depression(s) in the top rim of the upper member 406. Any notch may flexible material attached, or coupled, to it.

Figure 5:
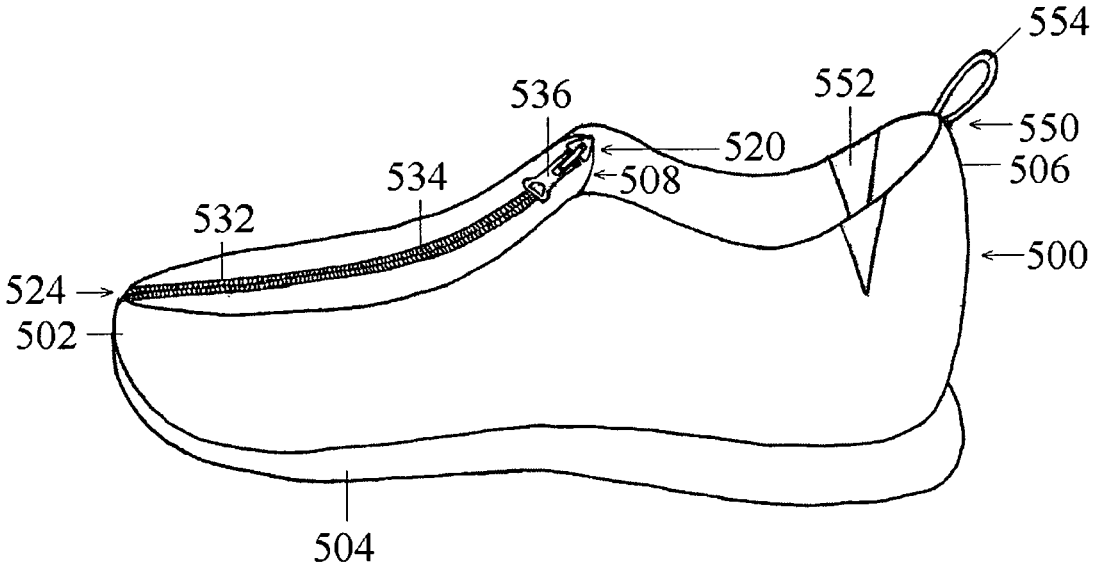

FIG. 5 illustrates an embodiment of system 500 that is similar to the embodiment shown in FIG. 4, except that FIG. 5 further illustrates a heel expanding system 550, which may include flexible closure material 552 embedded into both sides of the rear of the upper member 506, which can be expanded by pulling on a handle 554 to cause the opening 508 to further expand. When pulling is ceased, flexible closure material may help an upper member secure around an inserted foot.

Figure 6:
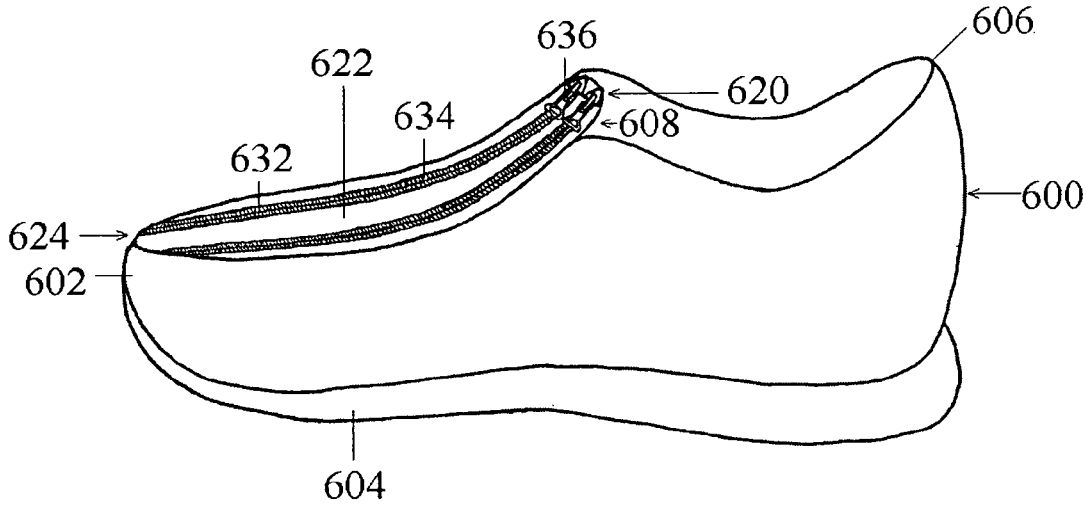
FIG. 6 illustrates an example of a shoe that has openings that extend into the toe box through zipper-secured slits located on both sides of the top of the front of the upper.

FIG. 6 illustrates an example system 600 of an article of footwear 602 in which a sole member 604 is attached, or coupled, to an upper member 606, which forms an opening 608 for insertion of a foot. The opening 608 extends into a toe box by means of two slits in the top of the upper member 606. The two slits define a top flap 622 that is capable of allowing a foot to be more easily inserted. Once a foot has been inserted through the opening 608, the footwear can be secured to a wearer's foot by means of a of a closure system 620 employing securing mechanisms 624, in this case two zippers 632, each with a slide 636 and teeth 634 connected to the upper member 606. Although two zippers are shown, it should be noted that any number of zippers could be employed at various parts in the upper member. Also, two or more slides associated with a plurality of zippers can be connected to each other (by way of example, but not limitation, at the zipper eyelets) by one or more connecting devices to permit a wearer to close the zippers more efficiently. A "connecting device" can be a strap, string, lace, rope, chain, elastic, neoprene or other material or other configurations suitable for connecting a plurality of securing mechanisms. Although not shown, a hinge or hinges may be coupled to the top flap 622 and the upper member 606 at or near the front of the toe box.

Figure 7:
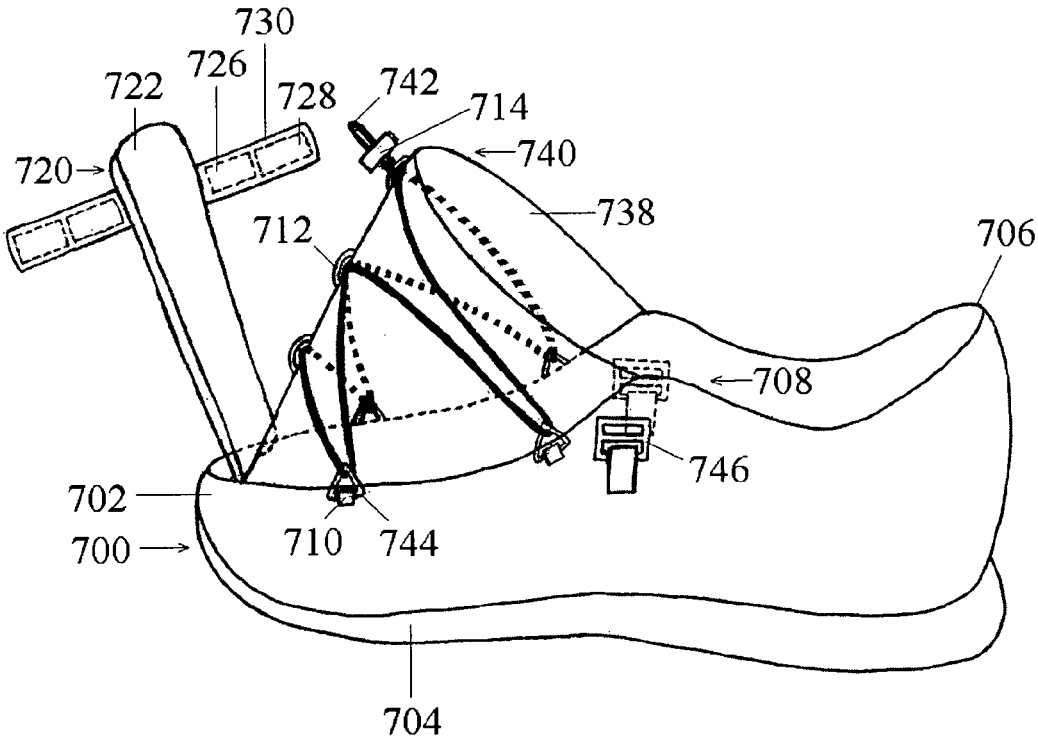
FIGS. 7 and 8 illustrate a shoe with both an opening and waterproofing system, each having an opening that extends into the toe box.

FIG. 7 illustrates an alternative example system 700 of an article of footwear 702 in which a sole member 704 is attached, or coupled, to an upper member 706 that contains more than one securing mechanism, each of which may be involved in extending the opening 708 into the toe box. One securing mechanism is a top flap 722 with a strap 730 attached, or coupled, to each side. When opened, the top flap 722 allows a second securing mechanism comprised of, in this example, waterproofing material 738 also to be opened, thereby extending the opening 708 into the toe box and permitting a wearer's foot to be inserted or removed more easily. The expanded opening 708 may be formed of waterproofing material 738 that is connected to the top rim of the front of the upper member 706 and has enough slack to allow a wearer's foot to be easily inserted or removed. Although the illustration in FIG. 7 shows waterproofing material, any material regardless of its waterproof or water resistant qualities can be used. Once a foot has been inserted into the expanded opening 708, the waterproofing material 738 can be secured around the foot by means of a secondary closure system 740 with a securing mechanism, in this example a spring slide 714 that can be used to cinch a lace 742 run in an alternating manner through lace loops 712, which are attached, or coupled, to the waterproofing material 738, and through hooks 744, which are connected to the upper member 706 by securing loops 710. The top flap 722 can be secured over the waterproofing material 738 by means of a closure system 720 with a securing mechanism, in this example opposing pieces of hook 726 and loop 728 fastener material attached, or coupled, to straps 730 that can be secured to buckles 746 attached, or coupled, to the upper member 706. Although not shown, a hinge or hinges may be coupled to the top flap 722 and the upper member 706 at or near the front of the toe box.

Figure 8:
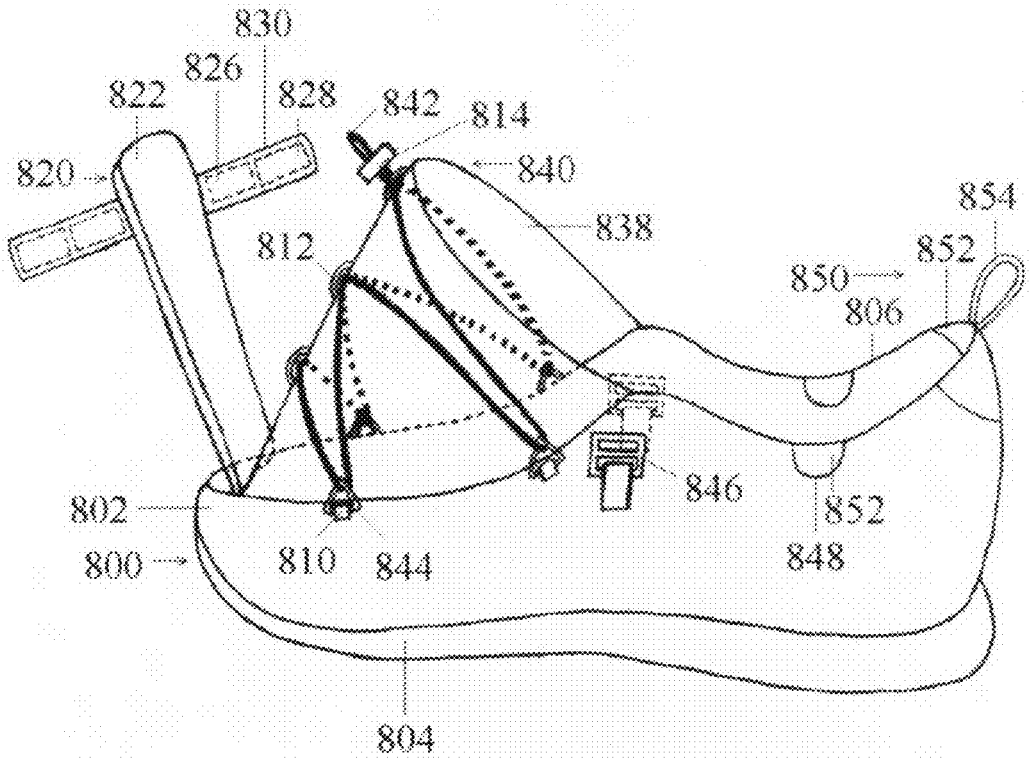

FIG. 8 illustrates an alternative example system 800 that is similar to the embodiment shown in FIG. 7, except that the embodiment in FIG. 8 further illustrates a heel expanding system 850 that includes flexible closure material 852 that makes up at least part of the heel of the upper member 806 that can be expanded by pulling on a handle 854 to cause the opening 808 to further expand. The embodiment in FIG. 8 also illustrates an example of a notch 848 that can be included in the sides of the upper member 806 to help accommodate hinge(s), buckle(s), strap(s), rivet(s) or snap(s) on an AFO, KAFO, DAFO or SMAFO. While the notches shown are semi-circles, a notch can be of any shape, such as semi-oval, squares, circles, triangles, rhombuses, parallelograms, or any other shapes capable of accommodating an AFO, KAFO, DAFO or SMAFO. Also, a single notch or a plurality of notches can be placed at any part of the upper where it might be advantageous to have part of the upper cut away to accommodate hinge(s), buckle(s), strap(s), rivet(s) or snap(s). In addition, flexible material 852 may be coupled to any notch or notches to help keep an AFO, KAFO, DAFO or SMAFO in place and to help provide support for the wearer. Any embodiment may include one or more notches and/or flexible material coupled thereto.

Figure 9:
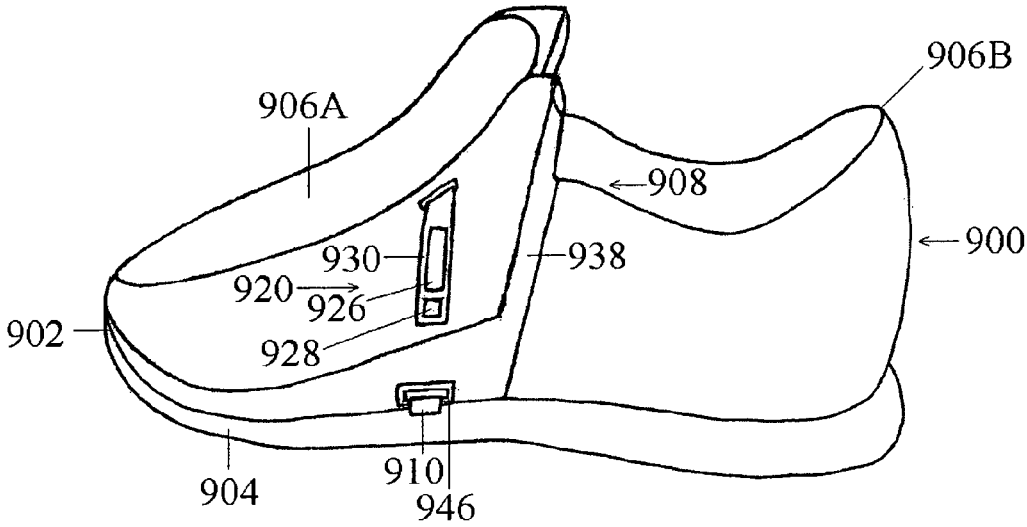
FIGS. 9 through 11 illustrate a shoe that has an opening that extends into the toe box at its base between the shoe sole and the base of the upper.

FIG. 9 illustrates an example system 900 of an article of footwear 902 in which a sole member 904 is attached, or coupled, to a front portion of an upper member 906A and a rear portion of an upper member 906B that contains an opening 908 for insertion of a foot. The opening 908 extends into a toe box by means of the front portion of the upper member 906A being capable of lifting up and away from the sole member 904 at or near the base of the front portion of the upper member 906A. Alternatively, a top part of the front portion of the upper member 906A may be capable of lifting up and away from a lower part of the front portion of the upper member, which lower part may be attached, or coupled, to the sole member 904. Once a foot has been inserted through the opening 908, the footwear can be secured to a wearer's foot by means of a of a closure system 920 employing a securing mechanism, in this case opposing pieces of hook 926 and loop 928 fastener material attached, or coupled, to a strap 930 that can be placed through a buckle 946 attached, or coupled, to the sole member 904 by a securing loop 910. The example system in FIG. 9 also can have waterproofing material 938 attached, or coupled, to both the front and back sections of the upper member 906A and 906B and to the sole member 904. The strap 930 can also be attached, or coupled, to the waterproofing material 938 on the inside of the front portion of the upper member 906A so that when the strap 930 is pulled, the waterproofing material 938 is pulled upward while the front portion of the upper member 906A is pulled downward, thereby causing the waterproofing material to stay inside the front portion of the upper member 906A. Although not shown, a hinge or hinges may be attached, or coupled, to the front portion of the upper member 906A and the sole member 904 near or at the front of the toe box.

Figure 10:
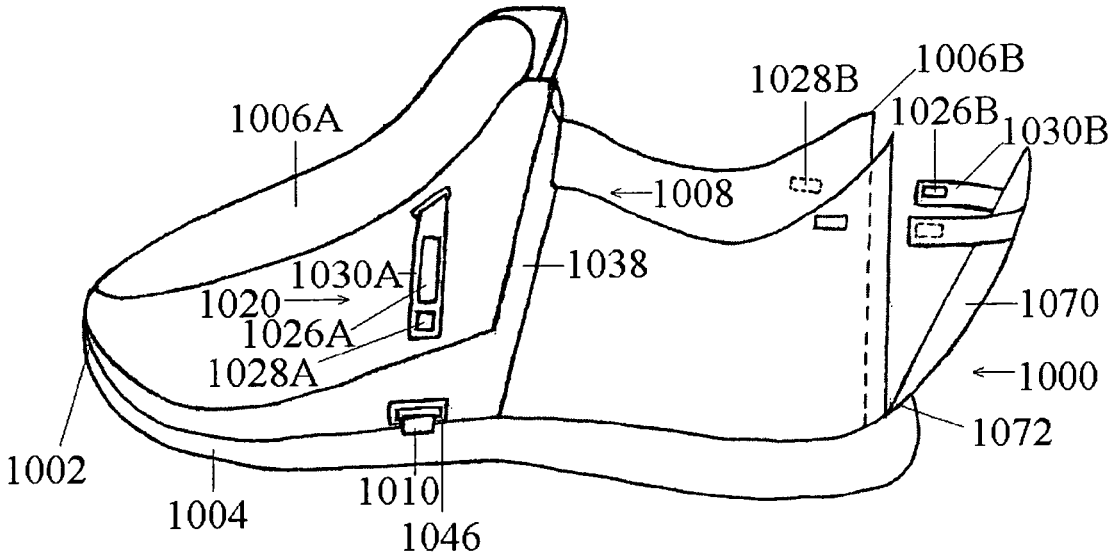

FIG. 10 illustrates an embodiment of a system 1000 that is similar to the embodiment shown in FIG. 9, except that the embodiment in FIG. 10 further illustrates a back member 1070, in this case a shoe back, that is capable of being opened via a hinge 1072 located near the sole member 1004. It should be noted that although the hinge in FIG. 10 is shown near the sole member, a hinge or hinges could be located part way down the back of the rear portion of the upper member 1006B, at the intersection of the shoe back and the sole member, in the sole member itself (including, without limitation, near the middle of the sole member), and/or any combination of the foregoing. A hinge may merely serve to connect the back member 1070 with the sole member 1004 or a lower part of the rear portion of the upper member 1006B or a hinge may provide tension that may assist with opening and/or closing the back member or otherwise securing the footwear around an inserted foot. Alternatively, the shoe back could be telescopically coupled to the shoe front (by way of example, but not limitation, by means of the sole member). After the wearer's foot has been inserted, the shoe back can be closed via a closure system with a securing mechanism, such as a strap 1030B with hook pieces of fastener material 1026B attached, or coupled. When the back member 1070 is closed around a wearer's foot, the hook pieces of fastener material 1026B can be secured to loop pieces of fastener material 1028B attached, or coupled, to the sides of the rear portion of the upper member 1006B. Alternatively, the locations of the hook 1026B and loop 1028B pieces of fastener material can be switched.

Figure 11:
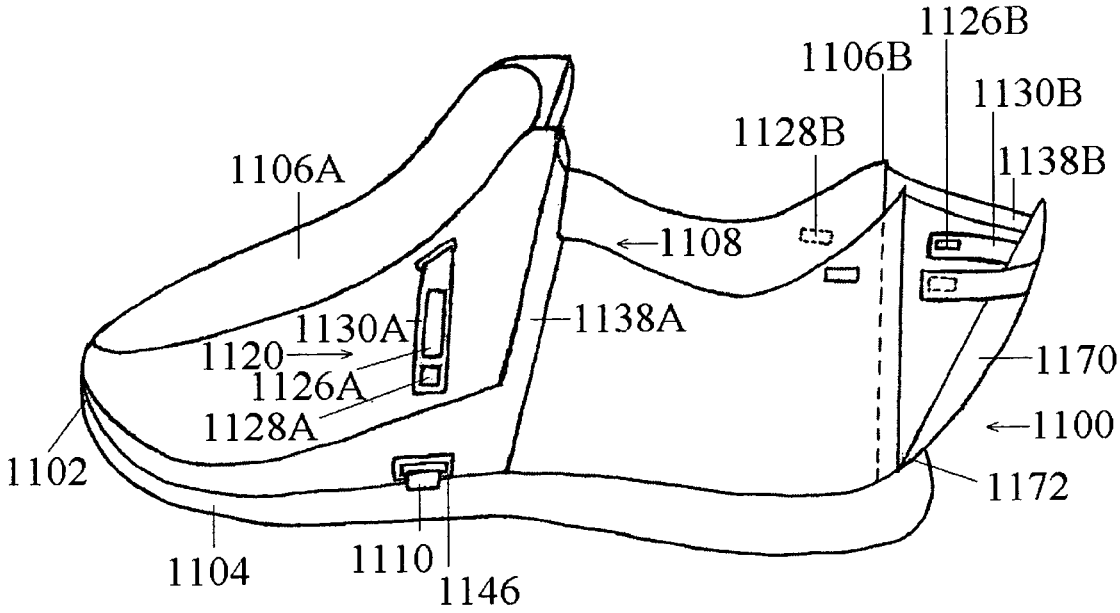

FIG. 11 illustrates an example system 1100 that is similar to the embodiment shown in FIG. 10, except that the embodiment shown in FIG. 11 further illustrates waterproofing material 1138A connected between the front portion of the upper member 1106A and the rear portion of the upper member 1106B and also waterproofing material 1138B connected between the rear portion of the upper member 1138B and the back member 1170.

Figure 12:
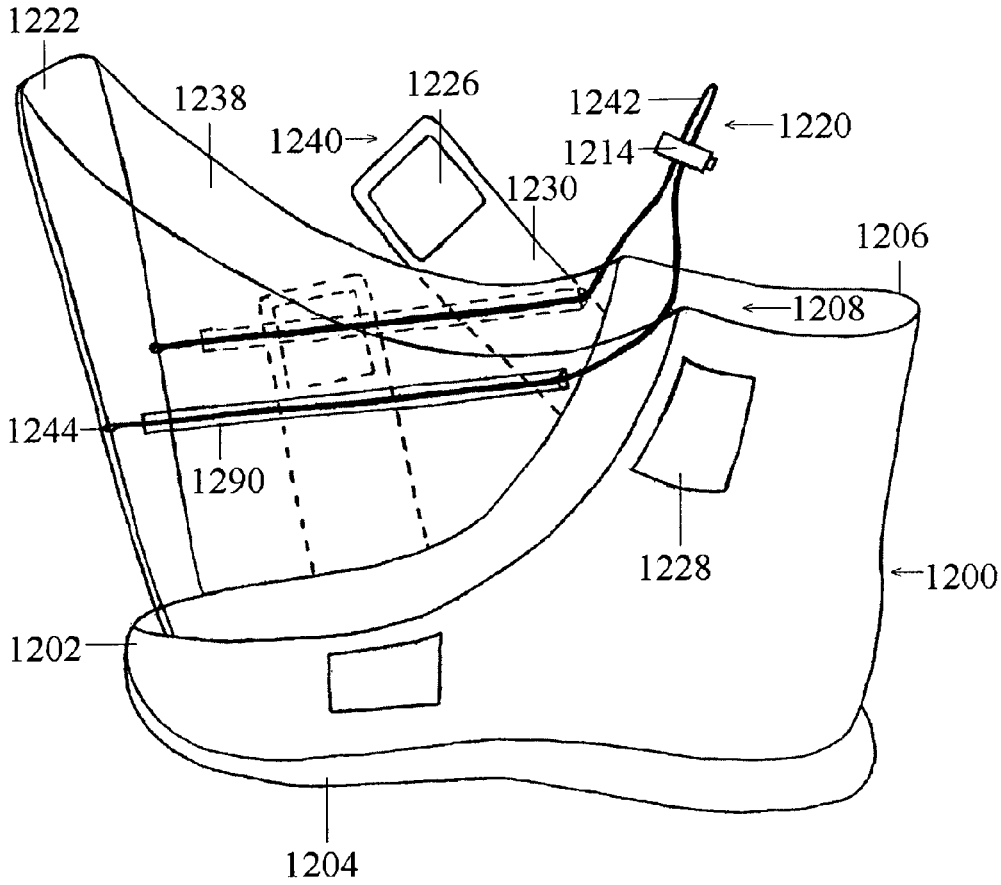
FIGS. 12 through 14 illustrate a boot that has an opening that extends into the toe box by means of an elongated top flap, with waterproof material attached, or coupled, between the top flap and the upper.

FIG. 12 illustrates an alternative example system 1200 of an article of footwear 1202 in which a sole member 1204 is attached, or coupled, to an upper member 1206 which forms an opening 1208 configured for insertion of a foot. The opening 1208 may be further defined by a toe box and a top flap 1222. Connected to both the top rims of the front of the upper member 1206 and the top flap 1222 may be waterproofing material 1238. Although the illustration in FIG. 12 shows waterproofing material, any material regardless of its waterproof or water resistant qualities can be used. Once a foot has been inserted into the expanded opening 1208, the waterproofing material 1238 and top flap 1222 can be secured around the foot by means of a closure system 1220 with a securing mechanism, in this example a spring slide 1214 that can be used to cinch a lace 1242 that runs through lace guides 1290, which may be flexible and attached, or coupled, to the waterproofing material 1238. Although lace is shown in the drawings, any material suitable for running through lace guides could be employed, such as string, rope, yarn, elastic, nylon, neoprene, plastic, or rubber banding for example. When pulled, the lace 1242, which is connected to the top flap 1222 via hooks 1244, can cause the top flap 1222 and waterproofing material 1238 to collapse and secure around a wearer's foot. The top flap 1222 can then be further secured by means of a secondary closure system 1240 with a securing mechanism, in this example opposing pieces of hook fastener material 1226 attached, or coupled, to straps 1230 that can be secured to loop fastener material 1228 attached, or coupled, to the upper member 1206. Alternatively, the location of the hook 1226 and loop 1228 fastener material can be reversed so that the hook fastener material 1226 is attached, or coupled, to the upper member 1206, while the loop fastener material 1228 is attached, or coupled, to the straps 1230. Although not shown, a hinge or hinges may be coupled to the top flap 1222 and the upper member 1206 at or near the front of the toe box.

Figure 13:
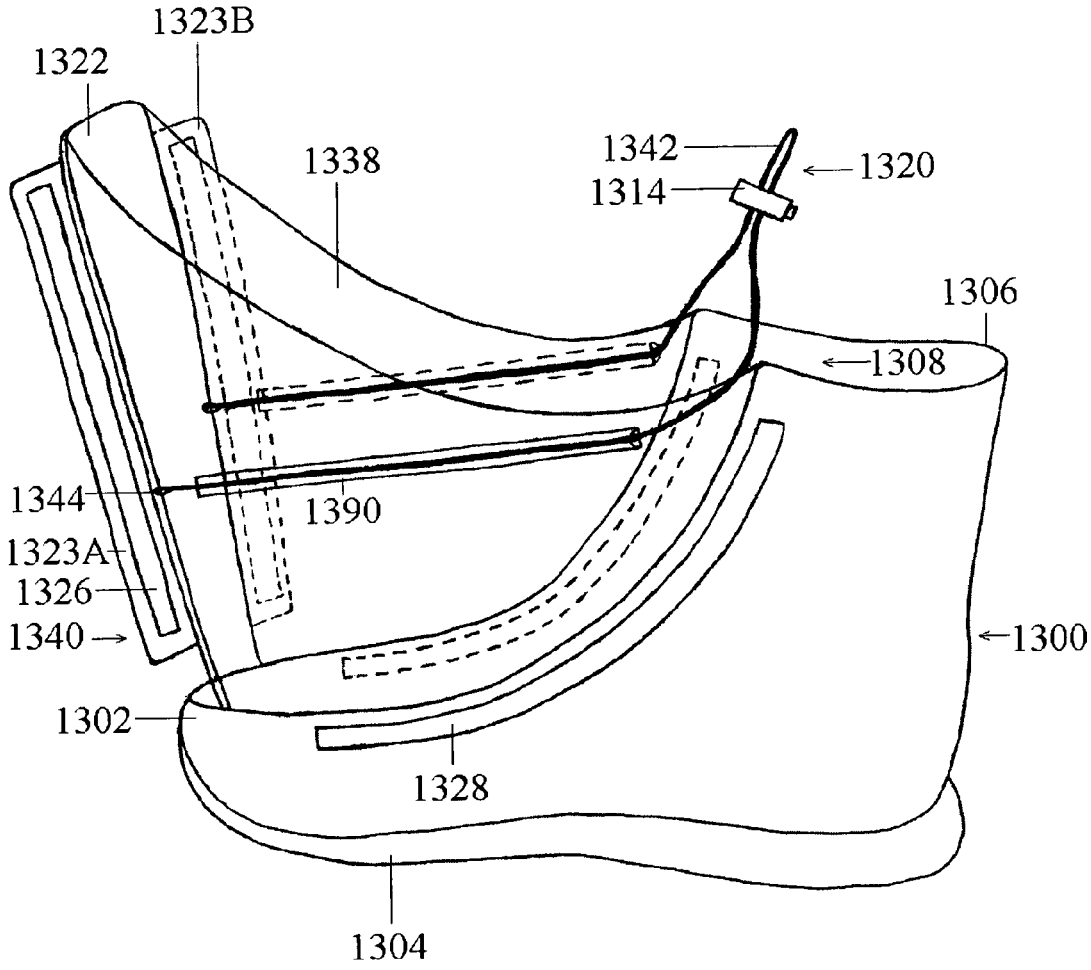

FIG. 13 illustrates an alternative embodiment of a system 1300 that is similar to the embodiment shown in FIG. 12, except that the embodiment shown in FIG. 13 illustrates a secondary closure system comprised of securing flaps 1323A and 1323B, rather than straps, to secure the boot around a wearer's foot. A secondary closure system can utilize any number of securing mechanisms without straying from the spirit and scope of this disclosure.

Figure 14:
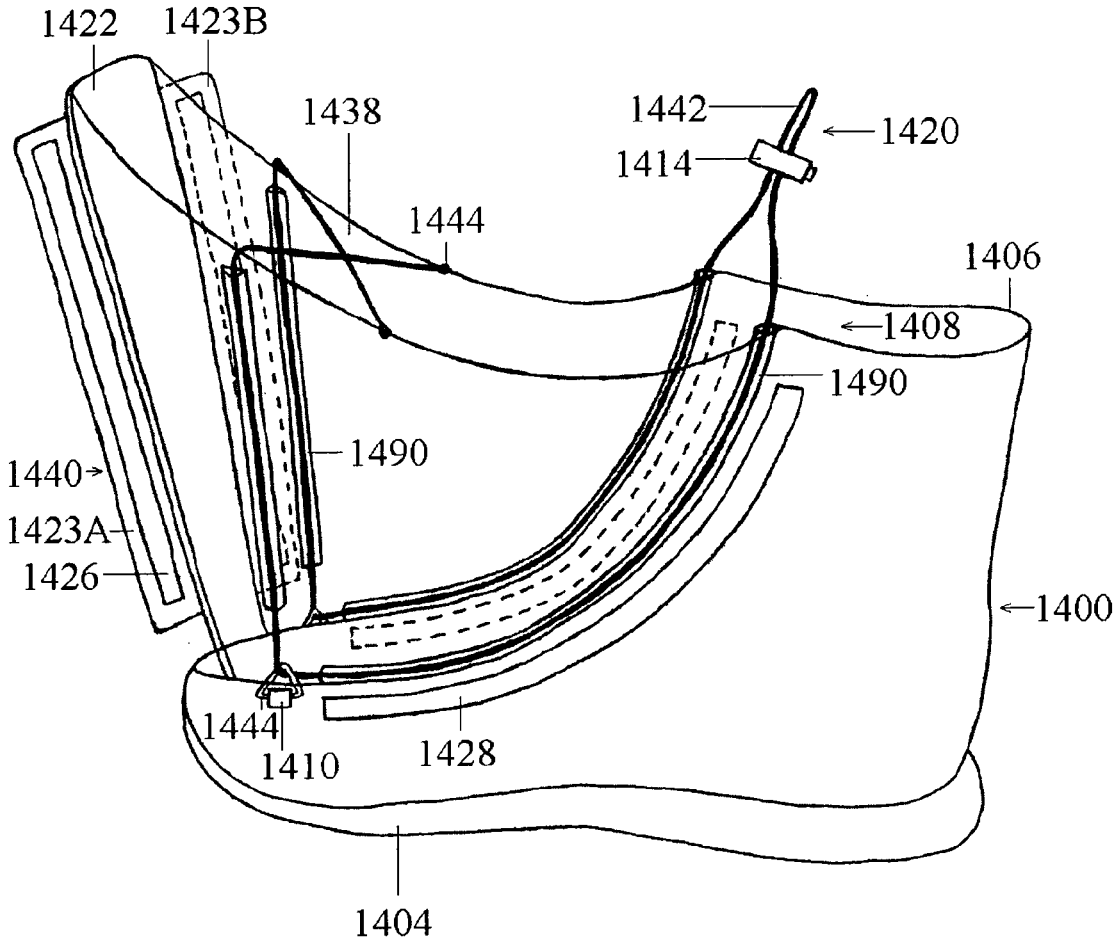

FIG. 14 illustrates an alternative example system 1400 that is similar to the embodiment shown in FIG. 13, except that the embodiment in FIG. 14 illustrates lace 1442 being run through two of sets lace guides 1490, one set attached, or coupled, along the front rim of the upper member 1406 and the other attached, or coupled, vertically or near vertically to the waterproofing material 1438. The lace 1442 may be capable of crossing and connecting via hooks 1444 to the top of the waterproofing material 1438 after passing through the vertical or near vertical lace guides 1490.

While the invention has been described with respect to exemplary embodiments, one skilled in the art will recognize, based on the disclosures herein, that various modifications, additions, omissions, combinations, alternative constructions and equivalents are possible and may be made without departing from the spirit and scope of the invention. Accordingly, the above description should not be construed as limiting the scope of the invention.

COPYRIGHT STATEMENT

This patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights.

We claimed:

1. An article capable of receiving at least a portion of an inserted foot or orthotic brace, the article comprising:

a base member at least partially coupled to or integrated with an upper member;

the upper member comprising a first side and a second side, wherein a cavity capable of receiving at least a portion of the inserted foot or orthotic brace is formed by at least a front portion of the base member and front portions of the first and second sides of the upper member, wherein the front portion of the first side of the upper member and the front portion of the second side of the upper member define, at least in part, one or more openings that extend into the cavity;

a top flap comprising a first side, a second side, a lower end, and a top end, wherein the lower end of the top flap is at least partially coupled to a hinge, wherein the hinge is at least partially coupled to the upper member near or at the front of the cavity;

a first strap attached or coupled to the first side of the top flap;

a second strap attached or coupled to the second side of the top flap;

a protective material attached at or near a top rim of the front portion of the upper member and continuously extending from the first side to the second side of the upper member;

at least one loop attached or coupled to the protective material;

a plurality of hooks attached or coupled to the upper member;

a spring slide; and lace which, when pulled through the at least one loop and the plurality of hooks and secured by the spring slide, is capable of securing the protective material, wherein at least one of the protective material and the top flap are capable of extending upward at least sixty-seven degrees relative to the base member.

2. An article according to claim 1, further comprising one or more notches in the upper member.

3. An article according to claim 2, further comprising flexible material at least partially coupled to the one or more notches in the upper member.

4. An article according to claim 3, wherein the one or more notches in the upper member comprise a notch in the back of the upper member, and further comprising a handle that is attached to the flexible material at least partially coupled to the notch in the back of the upper member and that is capable of being pulled to expand the back of the upper member.

5. An article according to claim 3, wherein the flexible material is selected from a group consisting of one or more of rubber, elastic, nylon, Lycra, neoprene, spandex, polyester, and polypropylene.

6. An article capable of receiving at least a portion of an inserted foot or orthotic brace, the article comprising:

a base member at least partially coupled to or integrated with an upper member;

the upper member comprising a first side and a second side, wherein a cavity capable of receiving at least a portion of the inserted foot or orthotic brace is formed by at least a front portion of the base member and front portions of the first and second sides of the upper member, wherein the front portion of the first side of the upper member and the front portion of the second side of the upper member define, at least in part, one or more openings that extend into the cavity;

securing mechanisms comprising a flap and protective material, wherein the flap is coupled to the upper member at or near the front of the cavity, wherein the protective material is attached at or near a top rim of the front portion of the upper member beginning on the first side at or near the back of the cavity, continuing around the top rim to a point at or near the front of the cavity and ending on the second side at or near the back of the cavity, and wherein the protective material, when not secured, is capable of extending upward up to sixty-seven degrees relative to the base member;

a first closure system attached or coupled to the first side of the flap;

a second closure system attached or coupled to the second side of the flap; and a third closure system attached or coupled to the protective material, wherein at least one of the first closure system, the second closure system and the third closure system is selected from a group consisting of one or more straps, pieces of hook and loop fastener material, buckles, spring slides, laces, lace loops, hooks, and securing loops.

7. An article according to claim 6, wherein the first side of the upper member contains a first notch defined by a first depression in the top rim of the upper member, and wherein the second side of the upper member contains a second notch defined by a second depression in the top rim of the upper member.

8. An article according to claim 7, wherein the first notch and the second notch are capable of accommodating at least a portion of the inserted orthotic brace.

9. An article according to claim 7, further comprising flexible material attached or coupled, to at least one of the first notch and the second notch, wherein the flexible material is capable of providing greater stability for the inserted foot or orthotic brace.

10. An article according to claim 7, further comprising a third notch defined by a third depression in the top rim of the upper member.

11. An article according to claim 10, further comprising flexible material attached or coupled to the third notch, wherein the flexible material is capable of providing greater stability for the inserted foot or orthotic brace.

12. An article according to claim 6, wherein the flap, when closed, is on top of the waterproofing material.

13. An article according to claim 1, wherein the hinge is capable of providing tension to assist with at least one of opening the top flap and closing the top flap.

14. An article according to claim 1, wherein the lace is elastic lace.

15. An article according to claim 1, further comprising: opposing pieces of hook and loop fastener material attached or coupled to the first strap;

opposing pieces of hook and loop fastener material attached or coupled to the second strap;

a first buckle attached or coupled to the first side of the upper member; and a second buckle attached or coupled to the second side of the upper member.

16. An article according to claim 7, wherein the first notch is one of a semi-circle, semi-oval, square, circle, rhombus, or parallelogram and wherein the second notch is one of a semi-circle, semi-oval, square, circle, rhombus, or parallelogram.

17. An article according to claim 16, wherein the first notch and the second notch are capable of accommodating one or more hinges, buckles, straps, rivets or snaps on the orthotic brace.

18. An article according to claim 1, wherein the at least one loop attached or coupled to the protective material comprises three loops attached or coupled to the protective material, and wherein the plurality of hooks attached or coupled to the upper member comprises four hooks attached or coupled to the upper member.

* * * * *